US006027151A

United States Patent [19]

McNab et al.

[11] Patent Number: 6,027,151

[45] Date of Patent: Feb. 22, 2000

[54] UTENSIL HOLDER

[76] Inventors: Kathleen McNab, 821 Third St., Apt. 209; Lidia Moran, 821 Third St., Apt. 303, both of Santa Monica, Calif. 90403

[21] Appl. No.: 09/205,239

[22] Filed: Dec. 2, 1998

Related U.S. Application Data

[60] Provisional application No. 60/067,796, Dec. 3, 1997.

[51] Int. Cl.[7] ..... B25G 1/00

[52] U.S. Cl. ..... 294/1.1; 401/6; 30/298; 16/430

[58] Field of Search ..... 294/1.1, 25, 9, 294/99.1; 30/322–324, 327, 298; 401/6–8; 74/551.3, 551.8, 551.9; 16/114 R, DIG. 12

[56] References Cited

U.S. PATENT DOCUMENTS

| | | | |
|---|---|---|---|
| 561,101 | 6/1896 | Fanner et al. | 30/323 |
| 729,418 | 5/1903 | Robertson | 74/551.9 |
| 1,165,142 | 12/1915 | Stanton | 74/551.9 |
| 2,266,942 | 12/1941 | Wallace | 401/6 |
| 2,866,440 | 12/1958 | Green | 401/8 |
| 4,035,865 | 7/1977 | McRae | 294/1.1 |
| 4,523,781 | 6/1985 | Brody | 294/1.1 |
| 4,821,417 | 4/1989 | Levine | 401/6 |
| 5,354,140 | 10/1994 | Diakoulas | 401/6 |
| 5,857,241 | 1/1999 | Camp, Jr. et al. | 16/114 R |
| 5,860,190 | 1/1999 | Cano | 16/114 R |

*Primary Examiner*—Dean J. Kramer
*Attorney, Agent, or Firm*—Walter A. Hackler

[57] ABSTRACT

A utensil holder is provided which generally includes a plurality of resilient, interconnected coils for enwrapping around a stem of a utensil or other instrument for facilitating manual manipulation of the utensil by young children or persons with special handicaps. The coils include an inner diameter which is expandable upon twisting of the holder along a longitudinal axis thereof. Upon expanding of the inner diameter, a utensil stem of any size or shape may be inserted within the coils. Resiliency and hysteresis of the coils cause the coils to contract about the utensil stem and resist rotation or longitudinal slippage while the utensil is in use.

16 Claims, 1 Drawing Sheet

UTENSIL HOLDER

The present application is a continuation of U.S. provisional application Ser. No. 60/067,796 filed Dec. 3, 1997 and is incorporated herein in its entirety by this specific reference thereto.

The present invention generally relates to a utensil holder and more specifically relates to a utensil holder that adjustably fits, and is removable from, a handle of most any ordinary utensil to facilitate gripping thereof by small children, toddlers and those with special needs.

Children begin the process of learning to feed themselves by using fingers in a pincer grasp fashion, using the thumb and index finger, to grip small bits of food, which are then pressed into the mouth, or elsewhere on the face. While the pincher grasp is being mastered for picking up and eating cracker crumbs and other tiny solid foods, infants are fed a variety of mashed and strained foods which make up the bulk of the child's solid food diet. Initially, this begins by a parent or care giver carefully scooping small spoonfuls of mashed or strained cereals, fruits and vegetables into the baby's open mouth.

Babies need to have developed proper tongue control to swallow strained and mashed solid foods, and thus early attempts at feeding an infant usually result in the majority of the food being pushed back out of the mouth by a natural thrusting action of the tongue. New parents may be surprised to find that mealtime becomes an even messier experience in later infant and toddlerhood. Infants naturally reach for and grab at any approaching spoonful of food. Spoonfuls of food are then splattered about as the parent may try to dodge, usually without success, the tiny but determined hands of the baby.

This reaching and grabbing behavior is more than just a result of the baby's developing curiosity, but is also a manifestation of the babies growing sense of independence. These behaviors are the baby's earliest attempts at self feeding, and are a sign of normal, healthy infant development. Thus, rather than discouraging this behavior in order to limit the amount of after mealtime cleanup, it may be beneficial to encourage the infant to hold or manipulate the utensil during feeding. The present invention provides a unique tool for encouraging the child's development and growing sense of independence by facilitating the self feeding process.

Small scale eating utensils for infants and toddlers are well known, as well as a number of specially shaped utensils designed to facilitate self feeding, for example, small spoons with generally loop-shaped handles. A household might own no more than a few of these specialized utensils and, due to their small size, they are easily misplaced, lost or otherwise unavailable when needed. In addition, children quickly outgrow the special, small scale utensils as they reach toddlerhood. In some instances, a toddler may have become so accustomed to using small or special loop shaped utensils that it may become difficult for the child to later adjust to using an ordinary, full-sized, utensil.

For these reasons, parents eventually begin to offer ordinary utensils to a young child who is learning to self feed. Small children take pride in using such tools made for adults and "big kids". However, although an ordinary teaspoon or cake fork may have a sufficiently small head for fitting into the child's mouth, the handle thereof is typically too slender and awkward for a child to manipulate. This is due to physical limitations of the child as the small muscle groups in a young child's hand may not be sufficiently developed for handling the smooth, slender utensil. Thus, the process of learning to self feed becomes frustrating and discouraging. Ironically, those early attempts of the infant child to self feed often unfold into the toddler child's insistence that the parent feed him once again.

The present invention addresses the hereinabove problems by providing a tool for infants and children, which may be used to transform most any ordinary utensil into a "child-friendly" utensil. The removable utensil holder in accordance with the invention encourages self feeding, enhances motor skills, and fosters a child's self esteem by allowing him to easily use and manipulate a "big kid" utensil.

It will be appreciated that a broader aspect of the invention provides for a implement or instrument holder for use on toothbrushes, pencils, pens, paintbrushes and the like, for both children and adults. For example, the present invention provides a holder for facilitating manipulation of a writing instrument by persons with impaired manual dexterity such as persons suffering from arthritis or other diseases affecting the joints of the hands.

SUMMARY OF THE INVENTION

Accordingly, a utensil holder is provided for facilitating manual manipulation of a utensil or other instrument by a child or a person with disabilities. The utensil holder generally comprises coil means, including a plurality of coils for enwrapping a utensil stem, means for causing expansion of an inner diameter of the coil means upon twisting of the coils about a longitudinal axis of the coil means to thereby enable insertion of the utensil stem inside the plurality of coils, and means, including a resiliency and hysteresis of the coil means, for causing contraction of the coil means about the utensil stem in order to prevent rotation and longitudinal slippage of the plurality of coils about the utensil stem. Thus, the utensil holder remains fixed in place while enwrapped about the utensil stem, while being easily placed on and easily removed from a utensil stem by merely twisting the coil means along the longitudinal axis to expand the inner diameter of the coils.

In addition, the utensil holder may further include means, defined by separations or spacing between each of the plurality of coils, for improving a grip as well as for facilitating positioning of a hand on the utensil stem when the coil means is enwrapped around the utensil stem. The separations may be sized for accommodating the fingers of a child such that a child's fingers or finger tips may be placed comfortably between the coils.

Preferably, the holder is made of a material having sufficient friction to enable the holder to be secured to a utensil stem in an adjusted position, for example, an elongated position or a position in which the spacings are variously expanded and contracted to accommodate different gripping styles and hands of different sizes. For example, the coil means may be made of a rubbery material such as SANTOPRENE. In addition, the plurality of coils may define a generally flattened, or planar, inner surface in order to optimize frictional surface contact between the coils and the utensil. For example, a cross section of the coils may be uniformly, generally unshaped, with a rounded outer surface and a planar inner surface.

In another aspect of the invention, a instrument holder may be provided for facilitating manual manipulation of a writing instrument by a person with impaired manual dexterity or with deformities of the hand. The adjustable spacings between the coils facilitate placement of different shapes and sizes of fingers, even those severely crippled or deformed by arthritis, securely between the coils. Advantageously, therefore, the holder of the present invention enables a disabled person to hold and manipulate an ordinary pencil or other tool.

BRIEF DESCRIPTION OF THE DRAWINGS

The present invention will be more clearly understood with respect to the following detailed description and the accompanying drawings of which.

DETAILED DESCRIPTION

Figure 1:
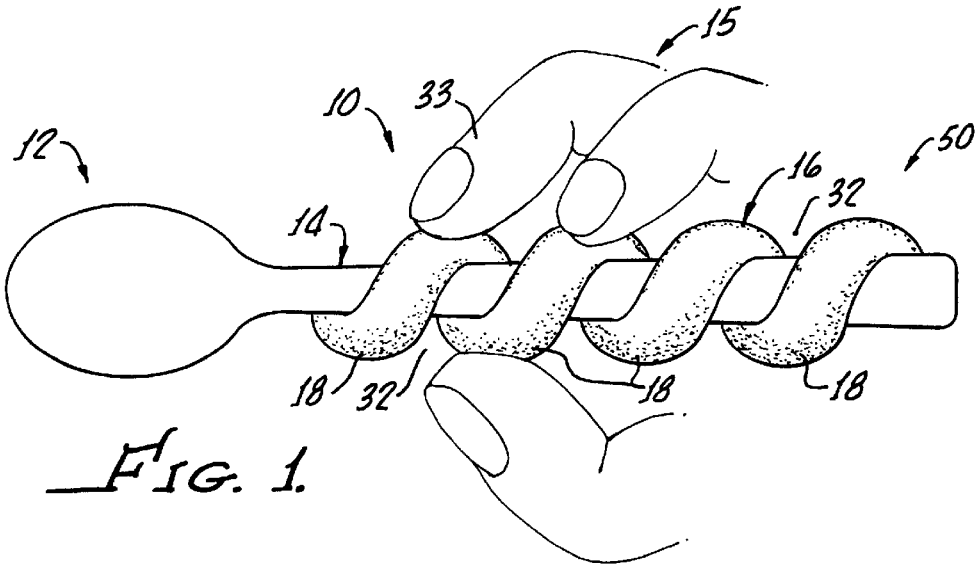
FIG. 1 shows a perspective view of a utensil holder in accordance with the present invention, being removably secured to an ordinary kitchen spoon.

Turning now to FIG. 1, a utensil holder 10, in accordance with the invention, is shown enwrapped around a utensil 12. Unless stated otherwise herein, it should be appreciated that the term "utensil" as used hereinafter will generally refer to any utensil, tool, implement, writing instrument and the like, having a stem 14 for enabling manual handling thereof. As will be hereinafter described, the holder 10 provides means for facilitating manual manipulation of the utensil 12 by a person such as a child, toddler or other person who may have difficulty handling an ordinary utensil due to a physical handicap or other special needs. For example, FIG. 1 shows in part, a child's hand 15 manipulating an ordinary teaspoon 12 with the utensil holder 10 removably secured thereto.

The holder 10 generally comprises coil means 16, including a plurality of interconnecting coils 18, for enwrapping the utensil stem 14.

Figure 2:
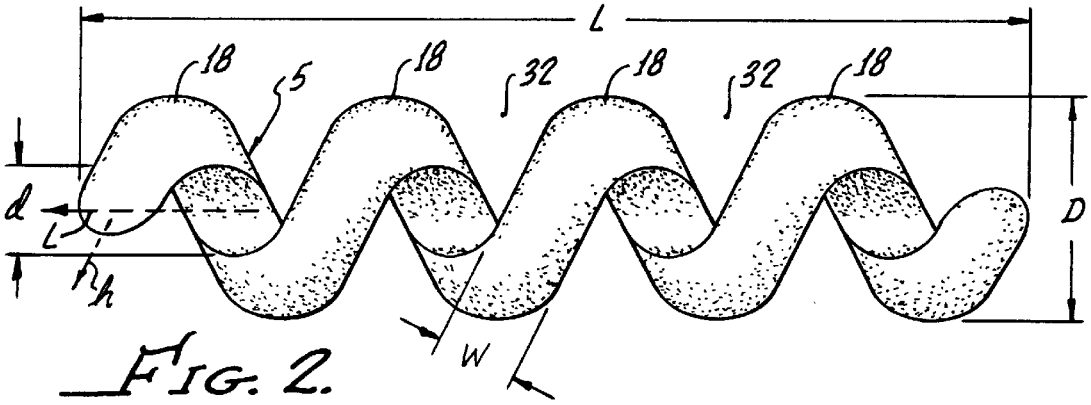
FIG. 2 shows a side view of the utensil holder of FIG. 1, said holder including a plurality of interconnected coils.
Figure 3:
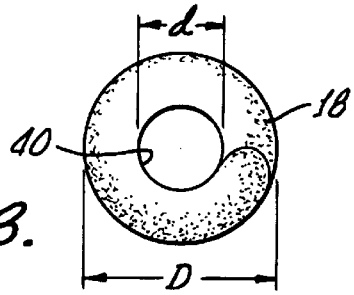
FIG. 3 shows a front view of the utensil holder including an inner diameter and an outer diameter of the plurality of coils.

More specifically, referring now as well to FIGS. 2 and 3, the coil means 16 includes an inner diameter d, an outer diameter D (see FIGS. 2 and 3), a longitudinal axis L, and a helical axis h (see FIG. 2). The helical axis is defined herein as an imaginary line along the plurality of coils 18 as shown in FIG. 2.

As a specific example, though not intended to limit the scope of the invention thereto, the outer diameter D of the coil means 16 may be about 1.00 inches in width. A length of the holder 10 may be about 3.50 inches measured along the longitudinal axis L, and about ten inches along the helical axis h. The plurality of coils 18 preferably comprises at least four interconnected coils 18. As shown in FIG. 3, the coils 18 are preferably circular in form.

The coil means 16 is comprised of a flexible, rubbery material. The material is preferably nonporous allowing for easy cleaning and disinfecting between uses, and nontoxic and unbreakable through normal use, such that it may be used safely by young children. For example, the material may comprise Santoprene or another suitable material.

The coil means 16 is preferably a uniform spiral or helical form such that the flexible, interconnecting coils 18 provide means for causing expansion of the coil means inner diameter d upon twisting of the coils 18 about the longitudinal axis L. Expansion of the inner diameter d enables insertion of the stem 14 inside the plurality of coils 18. The flexibility of the coil means 16 allows for insertion of various sizes and dimensions of utensil stems 14. Furthermore, a resiliency and hysteresis of the coil means 16 provides means for causing contraction of the coil means 16 about the inserted utensil stem.

Importantly, the inner diameter d of the coil means 16 is sized such that upon such contraction of the coil means, the holder 10 is engaged securely to the stem 14 in order to prevent rotation and longitudinal slippage of the plurality of coils 18 about the utensil stem 14. For accommodating most ordinary utensils, the inner diameter d, in the contracted state, may be about 0.25 inches or less.

Although the utensil holder 10 remains in place when contracted about the utensil 12, it is easily removable therefrom by manually twisting the coil means 16 about the longitudinal axis L to expand the inner diameter d of the coils 18, thereby releasing the utensil stem 14.

In addition, the holder 10 comprises means, defined by spacing or separations 32 between each of the plurality of coils 18, for improving a grip and facilitating positioning of a hand on the utensil stem 14 when the coil means 16 is enwrapped around the utensil stem 14. More particularly, each separation 32 between adjacent coils 18 may be between about 0.3 and about 0.5 inches wide when the holder 10 is not elongated or otherwise longitudinally adjusted. Spacings or separations 32 of this width will comfortably accommodate fingers 33 of a child (see FIG. 1).

The separations 32 may in some instances enhance a child's ability to grip the utensil 12 by providing spacing for placement and positioning of fingers 33 or fingertips between the coils 18 as shown in FIG. 1. This may be particularly beneficial when the hands of the child are soiled with wet or slippery foods. In other instances, very young children may prefer to clench the utensil 12 about the wide outer surface of the utensil holder 10 without necessarily placing fingers between the coils 18. The rubbery material, for example Santoprene, of the utensil holder will typically provide a firm, comfortable grip for a child even when hands are soiled.

Figure 4:
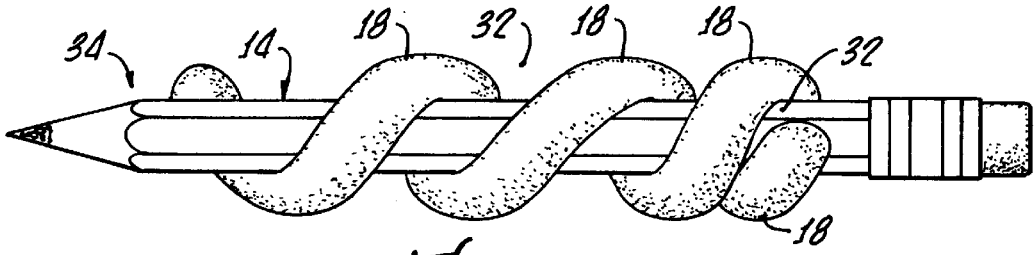
FIG. 4 shows the utensil holder including means for enabling the utensil holder to be removably secured to a writing instrument in a desired, variable position for accommodating different hand sizes and shapes, including deformities of the fingers.

The utensil holder 10 may further comprise friction means for enabling the holder 10 to be secured to a utensil stem 14 in an adjusted position, for example, an elongated position or a position in which the spacings 32 are variously expanded and contracted to accommodate fingers of various sizes, or different gripping styles. An example of an adjusted position is shown in FIG. 4, in which the utensil holder 10 is removably secured to a writing implement, in this case a pencil 34.

Figure 5:
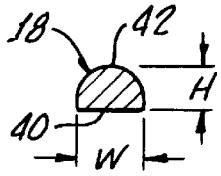
FIG. 5 shows a cross sectional view of the utensil holder taken along line 5—5 of FIG. 2.

This friction means is provided in part by the rubberiness of the coil means material, but further may be enhanced by a planar inner surface 40 of the coils 18 for increasing surface contact between the holder 10 and the utensil stem 14. For example, the coils 18 may have a uniform, generally unshaped, cross section such as shown in FIG. 5. The u-shaped cross section provides a comfortable, rounded outer surface 42 for the hand (not shown in FIGS. 4 and 5), and the planar inner surface 40 for contact with the utensil stem 14. As a specific example, a u-shaped cross section of the coils 18, taken across the helical axis, may measure about 0.38 inches in height H and about 0.44 inches in width W.

Turning back now specifically to FIG. 4, the holder 10 is shown as being used as an instrument holder 10 for facilitating manual manipulation of a writing instrument, such as the pencil 34, by a person (not shown) with impaired manual dexterity. As discussed above, by adjusting the spacing or separations 32 between the coils 18 the holder 10 provides means for facilitating placement of different sized fingers.

With respect to persons with special handicaps, the holder 10 can accommodate a user who is crippled by arthritis and who may have severely deformed fingers. By adjusting the coil spacing 32 as desired, the user may place his fingers between the coils 18 such that the coil means 16 secure the fingers in place about the instrument 33. Thus, the holder 10 provides substantial benefit to the disabled, by providing means for enabling a person, who otherwise could not do so, to write with an ordinary writing instrument 34.

It should be appreciated that a broad aspect of the present invention encompasses a utensil apparatus 50 (see FIGS. 1 and 4) which comprises the utensil holder 10 as hereinabove described as well as the utensil 12, 34 to which the holder 10 is removably engaged.

Although there has been hereinabove described a utensil holder, in accordance with the present invention, for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A utensil holder for facilitating manual manipulation of a utensil by a child or person with disabilities, said utensil holder comprising:

coil means, including a plurality of coils, for enwrapping a utensil stem, the coil means having an inner diameter, an outer diameter, a longitudinal axis, and a helical axis;

means, interconnecting said plurality of coils, for causing expansion of the coil means inner diameter upon twisting of the coils about the longitudinal axis in order to enable insertion of the utensil stem inside the plurality of coils;

means, including a resiliency and a hysteresis of the coil means, for causing contraction of the coil means about the utensil stem in order to prevent rotation and longitudinal slippage of the plurality of coils with respect to the utensil stem; and friction means, for enabling the coil means to be manually and removably secured to the utensil stem in a longitudinally adjusted position having a selected, variable spacial arrangement between the coils.

2. The utensil holder according to claim 1 further comprising means, defined by separations between each of the plurality of coils, for improving a grip and facilitating positioning of a hand on the utensil stem when the coil means is enwrapped around the utensil stem.

3. The utensil holder according to claim 2 wherein the separations between each of the coils are between about 0.3 and about 0.5 inches wide in order to comfortably accommodate fingers of a child.

4. The utensil holder according to claim 1 wherein the plurality of coils comprises about four interconnected coils.

5. The utensil holder according to claim 1 wherein the coil means is made of a material comprising Santoprene.

6. The utensil holder according to claim 1 wherein the plurality of coils have a u-shaped cross section, across the helical axis, defined by a flat inner edge for enhancing surface contact between the coils and the utensil stem.

7. A utensil apparatus comprising:

a utensil having a stem;

coil means, including plurality of coils, for enwrapping the utensil stem, the coil means having an inner diameter, an outer diameter, a longitudinal axis and a helical axis;

means, interconnecting said plurality of coils, for causing expansion of the coil means inner diameter upon twisting of the coils about the longitudinal axis in order to enable insertion of the utensil stem inside the plurality of coils;

means, including a resiliency and a hysteresis of the coil means, for causing contraction of the coil means about the utensil stem in order to prevent rotation and longitudinal slippage of the plurality of coils with respect to the utensil stem; and friction means, for enabling the coil means to be manually and removably secured to the utensil stem in a longitudinally adjusted position having a selected, variable spacial arrangement between the coils.

8. The utensil apparatus according to claim 7 further comprising means, defined by separations between each of the plurality of coils, for improving a grip and facilitating positioning of a hand on the utensil stem when the coil means is enwrapped around the utensil stem.

9. The utensil apparatus according to claim 8 wherein the coil means includes a u-shaped cross section, across the helical axis, defined by a flat inner edge for enhancing surface contact between the coils and the utensil stem.

10. The utensil apparatus according to claim 8 wherein the coil means is about 3.5 inches in length along the longitudinal axis thereof and about ten inches in length along the helical axis thereof.

11. The utensil apparatus according to claim 7 wherein the coil means is made of a material comprising Santoprene.

12. An instrument holder for facilitating manual manipulation of a writing instrument by a person with impaired manual dexterity or deformities of the hand, said instrument holder comprising:

coil means, including a plurality of coils, for enwrapping a writing instrument, the coil means having an inner diameter, an outer diameter, a longitudinal axis and a helical axis;

means interconnecting said plurality of coils, for causing expansion of the coil means inner diameter upon twisting of the coils about the longitudinal axis in order to enable insertion of the writing instrument inside the plurality of coils; and friction means, for enabling the coil means to be manually and removably secured to the utensil stem in a longitudinally adjusted position having a selected, variable spacial arrangement between the coils for accommodating placement of deformed fingers.

13. The instrument holder according to claim 12 wherein the plurality of coils comprises about four interconnected coils.

14. The utensil holder according to claim 13 wherein the plurality of coils have a u-shaped cross section, across the coil means helical axis, defined by a flat inner edge for enhancing surface contact between the coils and the writing instrument.

15. A utensil holder for facilitating manual manipulation of a utensil by a child, the utensil holder comprising:

a plurality of interconnected, spaced apart coils having a longitudinal axis, a uniform inner diameter sufficiently sized to enwrap a utensil stem, and an outer diameter sized to accommodate a manual grip of a child, the plurality of coils adapted to enable manual insertion and removal of the utensil stem upon twisting of the coils about the longitudinal axis and made of a flexible, rubbery material exhibiting sufficient friction to secure the coils in a selected spacial arrangement along the utensil stem.

16. The utensil holder according to claim 15 wherein the plurality of coils comprises about four coils, and is about 3.5 inches in length along a longitudinal axis thereof and is about ten inches in length along a helical axis thereof.

* * * * *